United States Patent [19]

Foeldesi et al.

[11] Patent Number: 4,662,822

[45] Date of Patent: May 5, 1987

[54] COOLER SHROUD ARRANGED AT THE COOLER OF A LIQUID-COOLED INTERNAL-COMBUSTION ENGINE

[75] Inventors: Mihaly Foeldesi, Plochingen; Thomas Attinger, Stuttgart, both of Fed. Rep. of Germany

[73] Assignee: Daimler-Benz Aktiengesellschaft, Fed. Rep. of Germany

[21] Appl. No.: 812,624

[22] Filed: Dec. 23, 1985

[30] Foreign Application Priority Data

Jan. 31, 1985 [DE] Fed. Rep. of Germany ..... 3503220

[51] Int. Cl.[4] ..... F04D 29/00

[52] U.S. Cl. ..... 415/213 C; 123/41.49; 165/135; 180/68.1

[58] Field of Search ..... 123/41.49; 415/213 C; 180/68.1, 68.4, 68.6; 165/121, 135

[56] References Cited

U.S. PATENT DOCUMENTS

| | | | |
|---|---|---|---|
| 2,668,523 | 2/1954 | Lamb | 123/41.49 |
| 3,937,192 | 2/1976 | Longhouse | 123/41.49 |
| 4,018,297 | 4/1977 | Haupt | 123/41.49 |
| 4,406,581 | 9/1983 | Robb et al. | 123/41.49 |
| 4,541,369 | 9/1985 | Ruhl | 123/41.49 |

FOREIGN PATENT DOCUMENTS

| | | | |
|---|---|---|---|
| 2505563 | 9/1975 | Fed. Rep. of Germany . | |
| 2130304 | 5/1984 | United Kingdom | 123/41.49 |

*Primary Examiner*—William A. Cuchlinski, Jr.
*Attorney, Agent, or Firm*—Barnes & Thornburg

[57] ABSTRACT

This invention relates to a cooler shroud detachably mounted to a heat exchanger of a liquid-cooled internal-combustion engine which includes a fan ring surrounding a fan driven by the internal-combustion engine. In order to be able to remove a cooler shroud that is arranged in narrow space conditions easily and without dismantling other components, the fan ring is detachably fastened to the cooler shroud.

8 Claims, 11 Drawing Figures

COOLER SHROUD ARRANGED AT THE COOLER OF A LIQUID-COOLED INTERNAL-COMBUSTION ENGINE

BACKGROUND AND SUMMARY OF THE INVENTION

This invention relates to a cooler shroud mounted to the heat exchanger of a liquid-cooled internal-combustion engine.

A liquid-cooled internal-combustion engine is shown in German Patent DE-AS No.25 05 563 having a heat exchanger at which a cooler shroud is fastened. The cooler shroud surrounds a fan driven on the side of the internal-combustion engine. This arrangement has the disadvantage that a disassembly of the cooler shroud is not possible without first removing the heat exchanger.

An objective of the present invention is to provide a cooler shroud of the initially mentioned type in such a way that in narrow space conditions a fast disassembly and removal of the cooler shroud and of the fan ring is Possible without the removing of adjacent components.

This and other objectives are achieved by providing an apparatus mounted to a heat exchanger of a liquid-cooled internal combustion engine comprising a cooler shroud detachably mounted to the heat exchanger, with at least one flange on its outer circumference, the flange having a slot; and a fan ring with a corresponding flange having a locking means which is inserted into the slot for fastening the fan ring and the cooler shroud by relative movement of the fan ring to the cooler shroud.

Other embodiments provide for the locking means to prevent relative rotation of the cooler shroud and the fan ring to be located on the cooler shroud, with the slots for receiving the locking means located in the fan ring.

The cooler shroud according to the invention has the advantage that, for motor vehicles with a short space between the front of the internal-combustion engine and the cooling arrangement, a disassembly of the cooler shroud and of the fan ring is possible without the dismantling of other engine parts. This facilitates the accessibility to the front of the internal-combustion engine for necessary maintenance and repair work In addition, a visual check of the periphery of the internal-combustion engine can be carried out more easily.

Further objects, features and advantages of the present invention will become more apparent from the following description when taken with the accompanying drawings, which show for purposes of illustration only, embodiments constructed in accordance with the present invention.

DETAILED DESCRIPTION OF THE DRAWINGS

Figure 1:
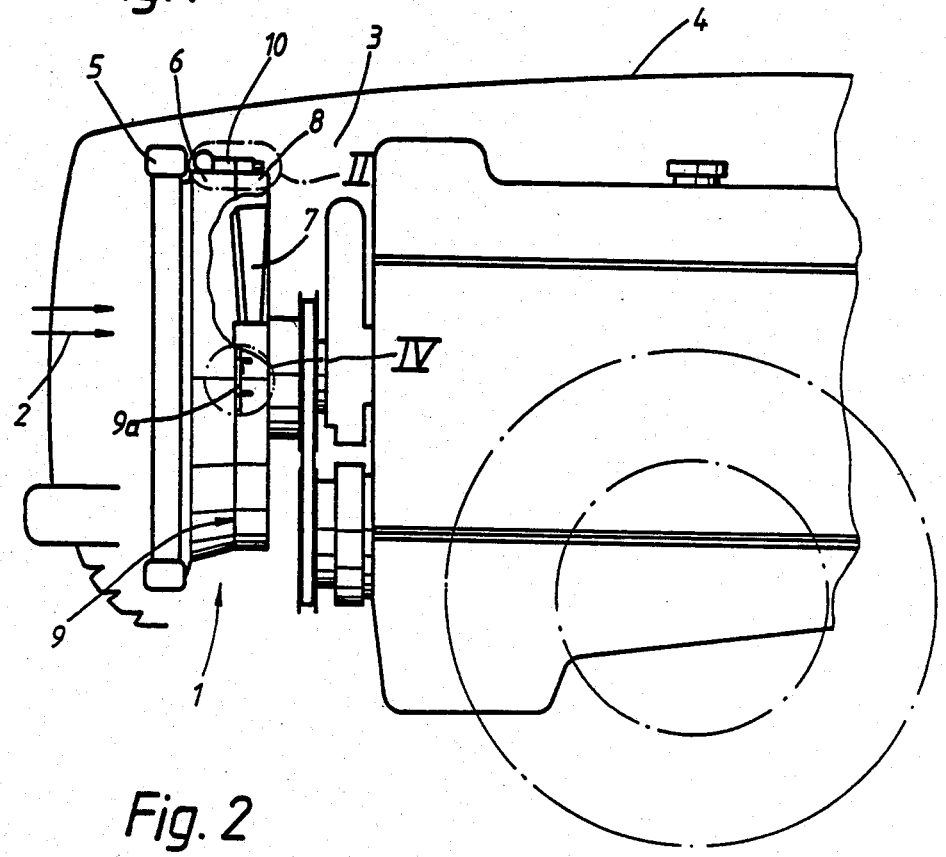
FIG. 1 is a lateral view of a preferred embodiment of a cooling arrangement for a liquid-cooled internal-combustion engine.

A cooling arrangement 1 in FIG. 1 is arranged in the cooling-air flow area 2 of an internal-combustion space 3 of an outlined motor vehicle 4 A cooler shroud 6 is detachably fastened at a heat exchanger 5 of the cooling arrangement 1. A fan 7 that is driven by the internal-combustion engine and assigned to the heat exchanger 5 is surrounded by a fan ring 8. The fan ring 8 is detachably fastened at the cooler shroud 6. The detachable fastening is a fastener 9 and comprises four fastening points **9*a* evenly distributed around the circumferences of the fan ring 8 and the cooler shroud 6. A rotation of the fan ring 8 with respect to the cooler shroud 6 is prevented by means of a locking pin 10**.

On the side of the cooler shroud 6 and the fan ring 8 are flange elements 11,12 respectively, the flange elements 11,12 corresponding to one another.

Figure 2:
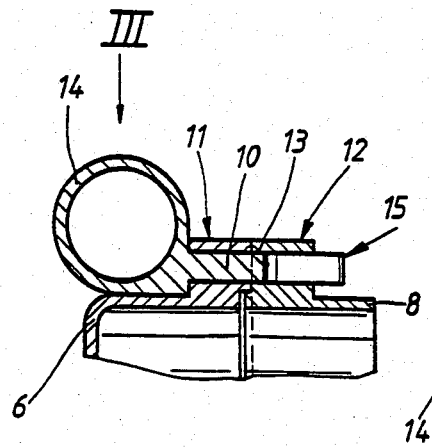
FIG. 2 is an enlargement of detail II from FIG. 1.
Figure 3:
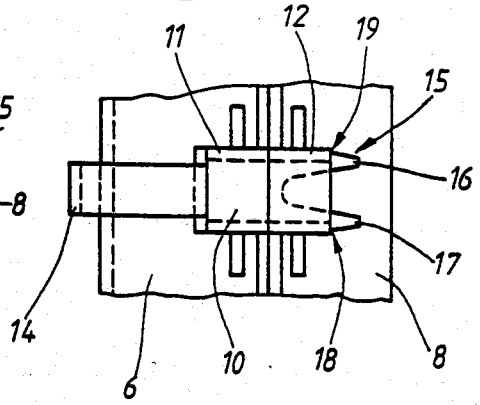
FIG. 3 is a plan view of the enlargement of FIG. 2 in the direction of arrow III in FIG. 2.

A receiving passage 13 in the flange elements 11,12 for the locking pin 10 is provided as shown in FIG. 2. On the side of the cooler shroud 6, the locking pin 10 is formed as a hose holder 14. The securin9 end 15 on the end of the locking pin 10 opposite the hose holder 14, as shown in FIG. 3, is a self-securing expanding element The slotted expanding element comprises two flexible legs 16,17, the end areas 18,19 of which have projecting widenings which support themselves at the flange segment 12 on the side of the fan ring 8.

Figure 4:
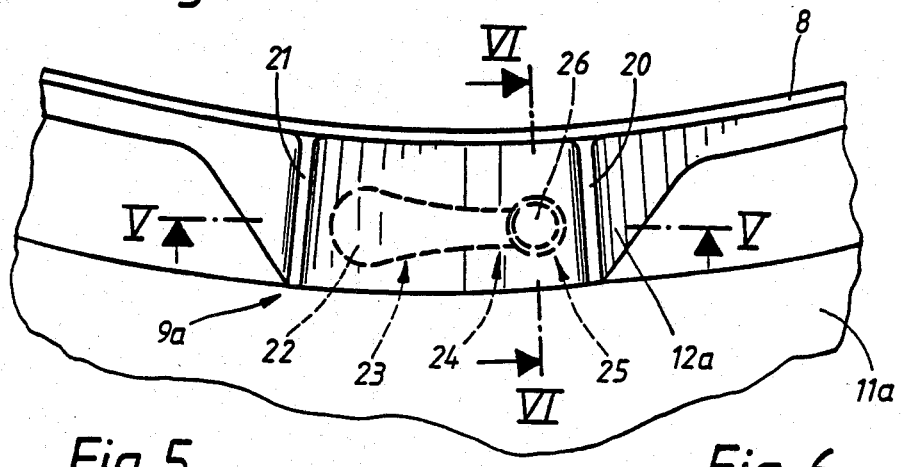
FIG. 4 is an enlarged rear view of the detail IV in FIG. 1.
Figure 5:
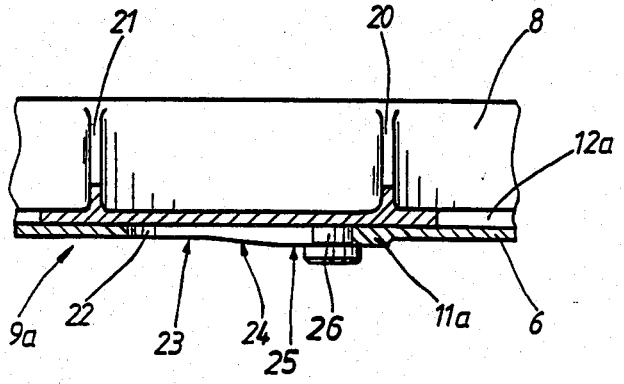
FIG. 5 is a cross-sectional view through line V—V in FIG. 4.

FIG. 4 shows a rear view of a fastening point **9*a* of the fastener 9 from a detail IV in FIG. 1. The flange element 12*a* of the fan ring 8 has stiffenings 20,21 which support themselves on the flange element 12*a* and at the fan ring 8. The flange segment 12*a* comprises a locking bolt 26 having a mushroom-shaped head (FIG. 5) which is inserted into a receiving opening 22 in the flange segment 11*a* of the cooler shroud 6. The receiving opening 22 is divided into a radial guiding area 23, and axial prestressing area 24 and a clamping area 25**.

Figure 6:
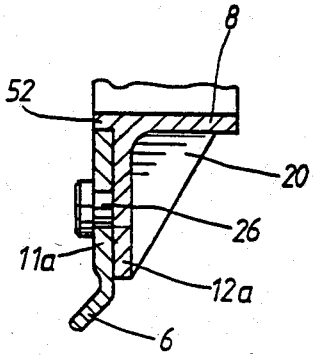
FIG. 6 is a cross-sectional view through line VI—VI in FIG. 4.

The cooler shroud 6, as shown in FIG. 6, comprises flange segments **11*a* which project into the interior of the cooler shroud 6. A sleeve-shaped extension 52 of the fan ring 8 supports itself at the interior circumference of the coooler shroud flange element 11*a* such that no ambient air can flow from the internal combustion engine spaee into the cooling air guiding space that is limited by the cooler shroud 6**.

Figure 7:
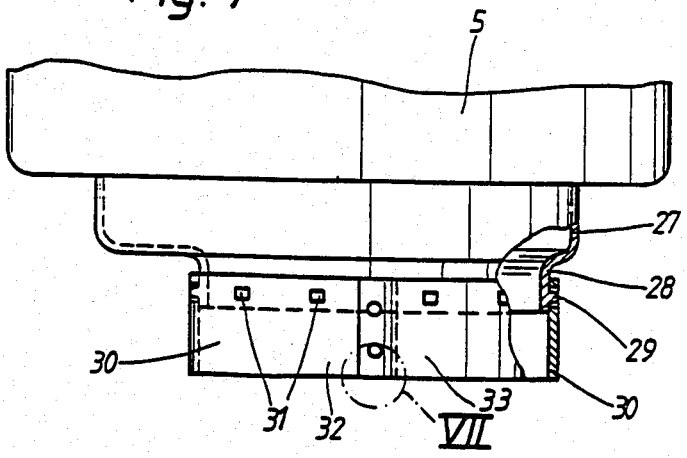
FIG. 7 is a plan view of a further embodiment of the present invention.
Figure 8:
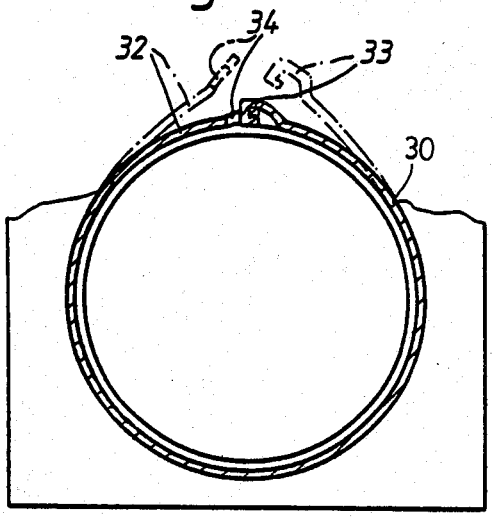
FIG. 8 is a rear view of the embodiment of FIG. 7.

In another preferred embodiment of the invention shown in FIG. 7, a cooler shroud 27 is detachably fastened at the heat exchanger 5. On the side opposite the heat exchanger 5, the cooler shroud 27 has a sleeve-shaped extension 28. The outer circumference of the sleeve-shaped extension 28 has knob-shaped elevations 29. A fan ring 30 which surrounds the sleeve-shaped projected 28 has receiving openings 31 which engage the knob-shaped elevations 29. As shown in FIG. 8, the fan ring 30 is split and has two end sides 32,33. The end side 32 has openings 34 into which the end side 33 is received which is shaped as a hook.

Figure 9:
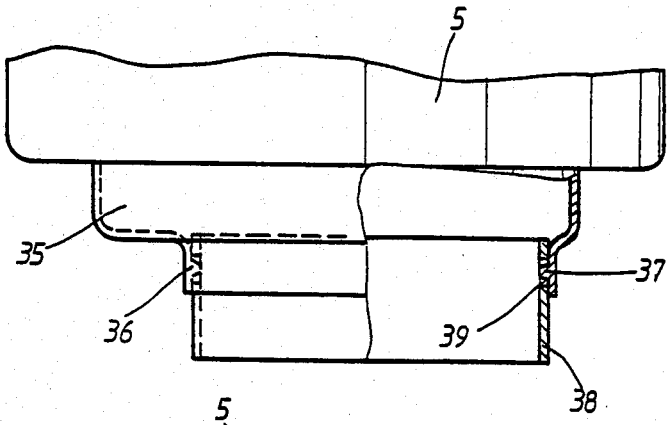
FIG. 9 is a partial sectional plan view of a further embodiment of the present invention.

In a further embodiment shown in FIG. 9, a cooler shroud 35 is detachably fastened at a heat exchanger 5. On the side opposite the heat exchanger 5, the cooler shroud 35 has a sleeve-shaped extension 36. The interior circumference of the sleeve-shaped extension 36 has knob-shaped elevations 37. A split fan ring 38 has recesses 39 which, when the fan ring 38 is fitted into the sleeve-shaped extension 36, become connected with the knob-shaped elevations 27.

Figure 11:
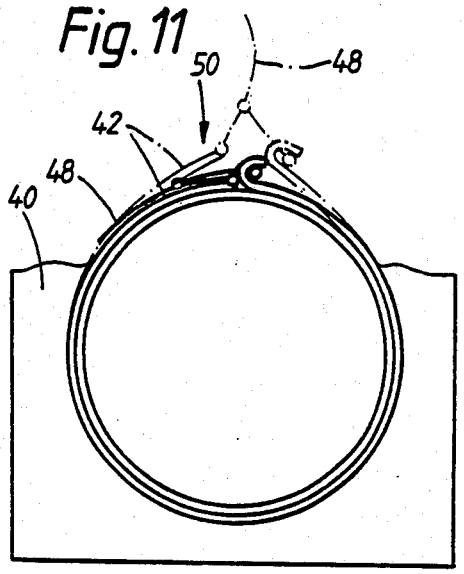
FIG. 11 is a rear view of the embodiment of FIG. 10.
Figure 10:
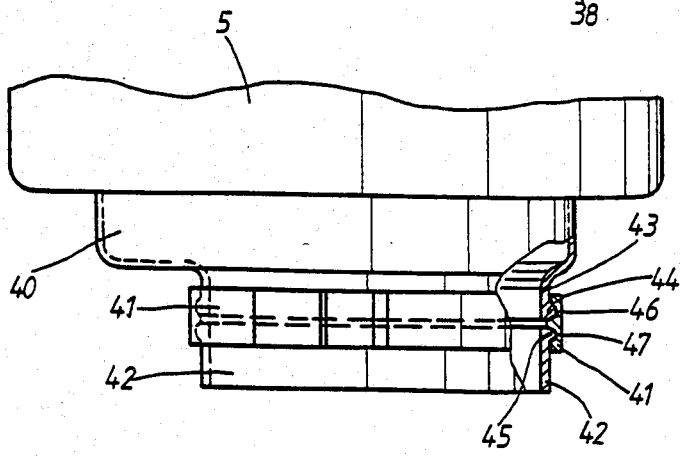
FIG. 10 is a partial sectional plan view of a further embodiment of the present invention.

The embodiment illustrated in FIG. 10 comprises the heat exchanger 5 at which a cooler shroud 40 is detachably fastened. By means of a tightening strap 41, a fan ring 42 is detachably fastened to the cooler shroud 40. On the side opposite the heat exchanger 5, the cooler shroud 40 has a sleeve-type extension 43 which, on its exterior circumference, has a surrounding ring web 44 with a trapezoidal cross-section. A ring web 45, also having a trapezoidal cross-section, is located at the exterior circumference of the fan ring 42. The ring webs 44,45 can be inserted into surrounding ring grooves 46,47 of the tightening strap 41 if this tightening strap 41, as indicated in phantom in FIG. 11, is in the opened condition. A toggle clamp 50 is fastened at the tightening strap 41. By actuating the toggle 48 in the counterclockwise direction in FIG. 11, the toggle clamp 50 is closed. The tightening strap 41 tightens around the cooler shroud 40 against the fan ring 42.

When repair or maintenance work is carried out on the front side of the internal-combustion engine, the cooler shroud 6,27,35 or the fan ring 8,30,38 can be removed from the cooling arrangement 1. This is carried out by unfastening the quarter-turn fastening between the cooler shroud 6,27,35 and the fan ring 8,30,38 by lifting in an upward direction the cooler shroud 6,27,34 which is detachably fastened at the heat exchanger 5. The fan ring 8,30,38 is pushed in the direction of the heat exchanger 5 and is also pushed upward from the installation space. This results in an improved accessibility to the front side of the internal-combustion engine.

Although the present invention has been described and illustrated in detail, it is to be clearly understood that the same is by way of illustration and example only, and is not to be taken bY way of limitation.

We claim:

1. An apparatus mounted to a heat exchanger of a liquid-cooled internal-combustion engine, comprising:

a cooler shroud detachably mounted to said heat exchanger, with at least one flange on the outer circumference of said cooler shroud, said flange having a slot; and a fan ring having a corresponding flange, said corresponding flange having a locking means for fastening said fan ring to said cooler shroud when said locking means is inserted into said slot and said fan ring is moved relative to said cooler shroud.

2. The apparatus of claim 1, wherein said locking means is mushroom-shaped.

3. The apparatus of claim 1, wherein said slot has a radial guiding area, an axial prestressing area and a clamping area.

4. The apparatus of claim 1, further comprising a self-locking pin means for fixing said fan ring from rotating with respect to said cooler shroud after said self-locking pin means is inserted and locked in said slot.

5. The apparatus of claim 4, wherein one end of said self-locking pin means includes a hose holder.

6. An apparatus mounted to a heat exchanger of a liquid-cooled internal combustion engine, comprising:

a cooler shroud detachably mounted to said heat exchaanger, said cooler shroud having a sleeve-shaped extension, said sleeve-shaped extension having at least one locking element;

a fan ring having at least one slot for receiving said at least one locking element in fastening said fan ring to said cooler shroud, wherein said fan ring is a split ring with at least one hook on one end of said split ring and at least one corresponding opening on the opposite end of said split ring for engaging said hook and securing said split fan ring to said cooler shroud.

7. An apparatus mounted to a heat exchanger of a liquid-cooled internal combustion engine, comprising:

a cooler shroud detachably mounted to said heat exchanger;

a fan ring; and a tightening strap encircling the adjoining ends of said fan ring and said cooler shroud for detachably fastening said fan ring to said cooler shroud, wherein said tightening strap has a toggle clamp for tightening said strap.

8. The apparatus of claim 7, whereing said adjoining ends of said cooler shroud and said fan ring each have a ring web with a trapezoidal cross-section, and said tightening strap has two corresponding grooves with trapezoidal cross-sections for receiving said ring webs when said tightening strap is tightened.

* * * * *